United States Patent [19]

Bogusz

[11] Patent Number: 4,648,140

[45] Date of Patent: Mar. 10, 1987

[54] DISH WASHING AID DEVICE

[76] Inventor: Walter F. Bogusz, 4350 S. Winchester Ave., Chicago, Ill. 60609

[21] Appl. No.: 739,285

[22] Filed: May 30, 1985

[51] Int. Cl.[4] ..... A47L 17/02

[52] U.S. Cl. ..... 4/654; 4/286; 4/427; 4/638; 134/115 R; 134/183

[58] Field of Search ..... 4/286, 290, 638, 651, 4/654, 656, 191, 427; 134/25.2, 92, 104, 115 R, 182, 183, 201; 137/590; 241/100, 100.5; 210/482

[56] References Cited

U.S. PATENT DOCUMENTS

| | | | |
|---|---|---|---|
| 347,684 | 8/1886 | Bunting, Jr. | 137/590 X |
| 1,165,665 | 12/1915 | Grande | 134/92 |
| 2,065,347 | 12/1936 | Schulse | 4/290 X |
| 2,671,909 | 3/1954 | Santarsiero | 4/287 |
| 2,753,571 | 7/1956 | Draper | 241/100.5 X |
| 3,333,283 | 8/1967 | Patterson | 4/656 |
| 3,377,634 | 4/1968 | Patterson | 4/656 X |
| 3,742,965 | 7/1973 | Hudziak | 134/115 R X |
| 4,033,461 | 7/1977 | Nevai | 4/656 X |
| 4,128,905 | 12/1978 | Mathes | 4/654 |

FOREIGN PATENT DOCUMENTS

| | | | |
|---|---|---|---|
| 2738931 | 3/1979 | Fed. Rep. of Germany | 4/286 |
| 984390 | 2/1951 | France | 137/590 |

*Primary Examiner*—Philip R. Coe
*Attorney, Agent, or Firm*—John J. Kowalik

[57] ABSTRACT

A dish washing aid device for segregating soapy dish water in a single basin kitchen sink, the device comprising a lower base portion adapted to seal with the bottom wall of the basin about a drain therein, the base portion having a water tight vertically adjustable swivel connection with an upper funnel-like portion serving as a diverter for rinse water and being adapted to be rotated to a position under the sink faucet so that the rinse water may be poured onto cleaned articles to rinse away the soapy water and diverted into the drain without diluting or draining the soapy water in which the remaining articles are soaking.

11 Claims, 8 Drawing Figures

FIG. 1
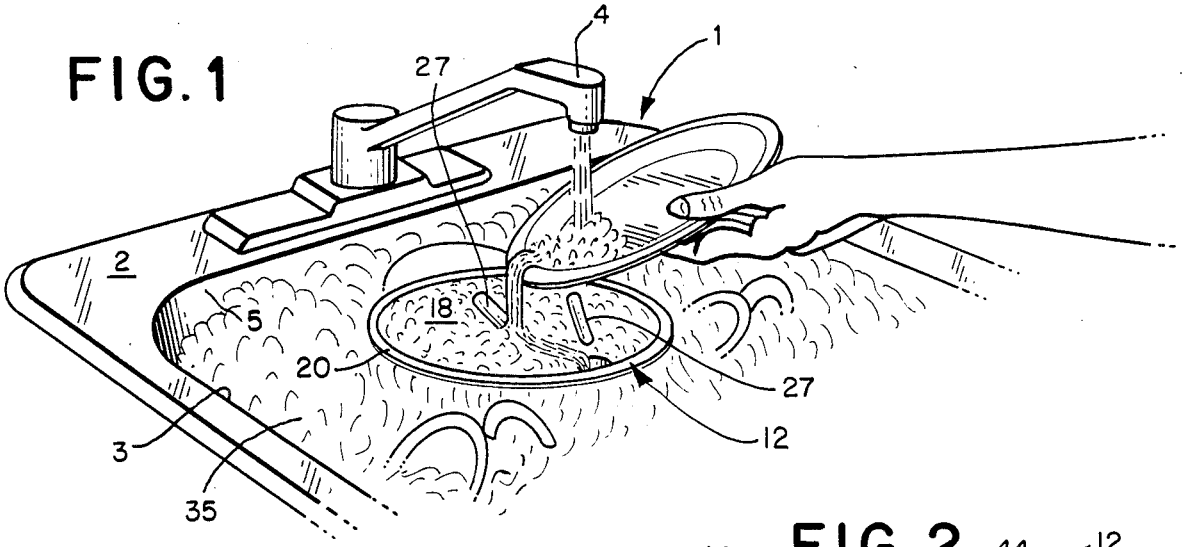
FIG. 2
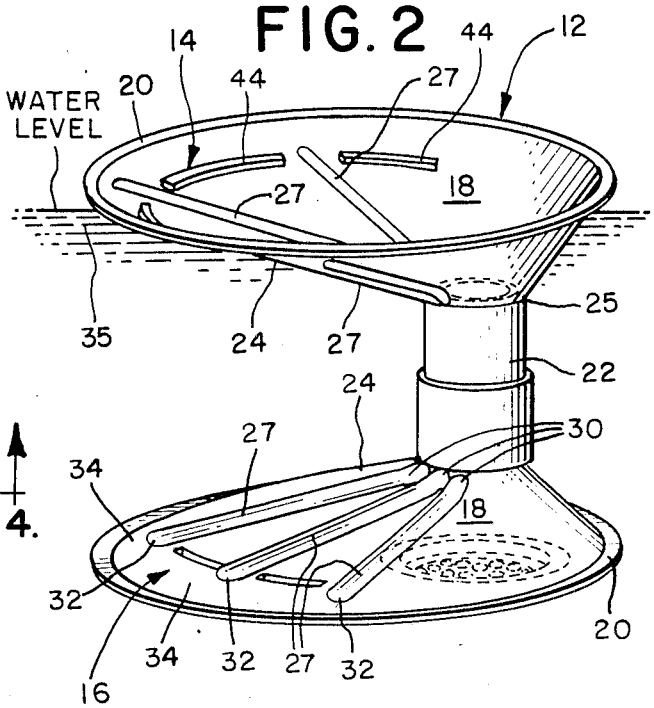
FIG. 3
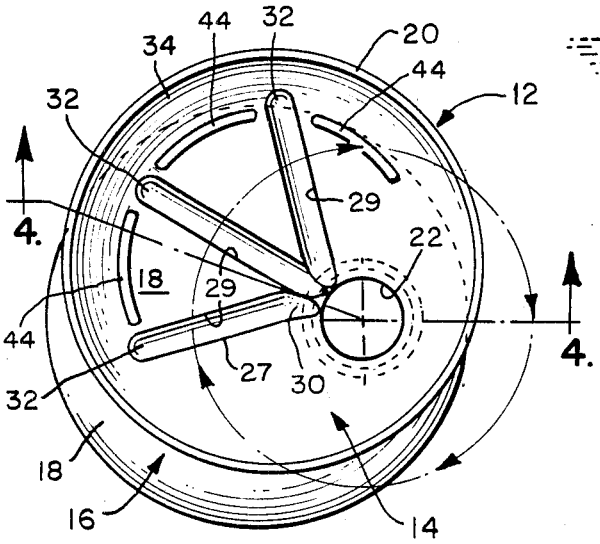
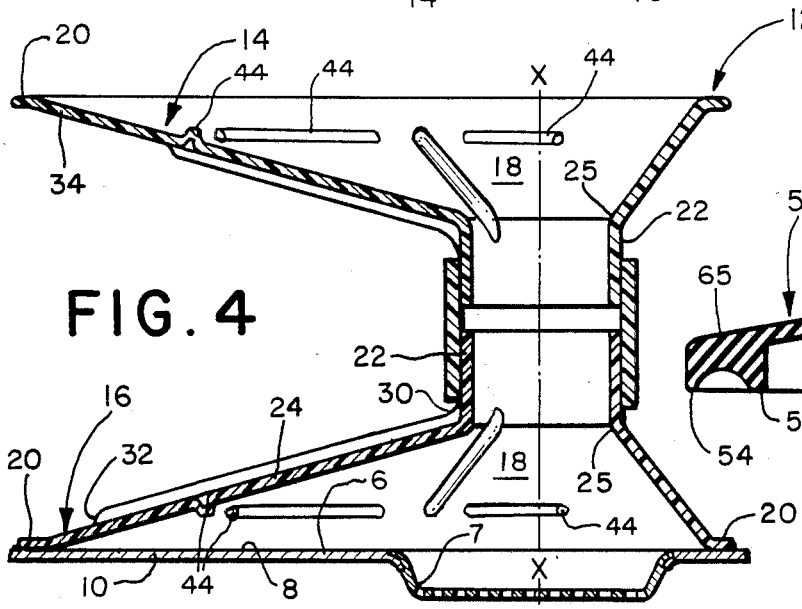
FIG. 4
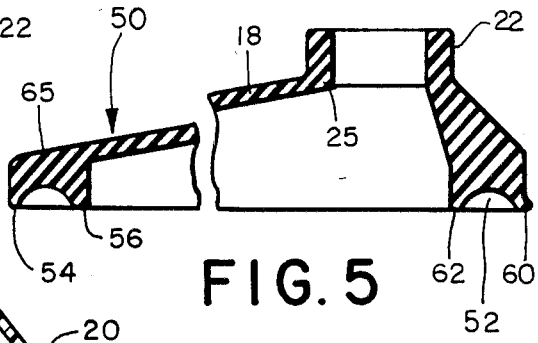
FIG. 5

FIG. 6
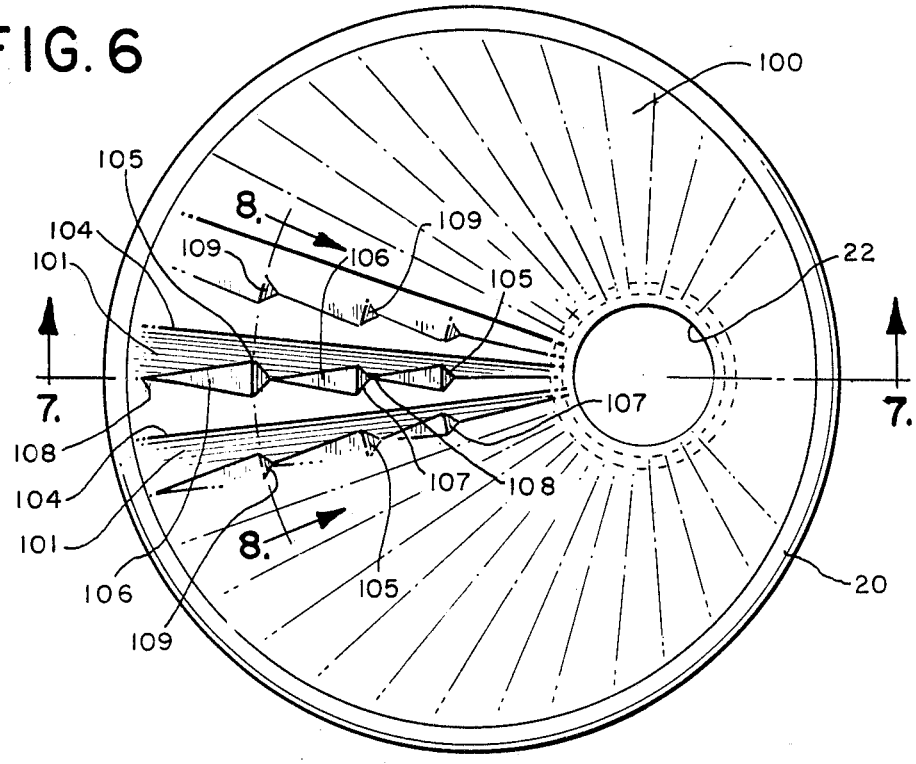
FIG. 7
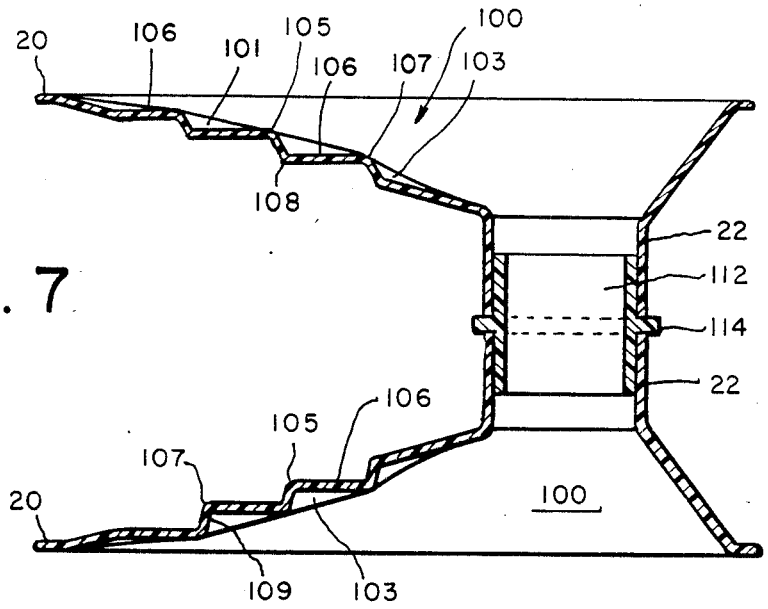
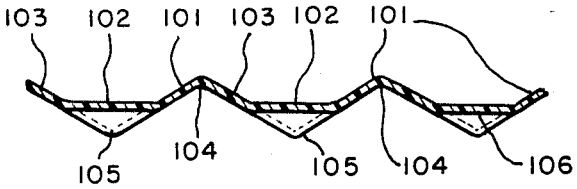
FIG. 8

DISH WASHING AID DEVICE

BACKGROUND OF THE INVENTION

During the past several decades there has been a trend to build small apartments and other housing and to minimize building costs dishwashers have been eliminated and single basin sinks have been installed.

Thus it has been virtually impossible heretofor impossible in a single basin sink to wash and at the same time to rinse the washed dishes. The dishes and other articles would first have to be washed and then stored on the counter top or side table and then the soapy water would be drained and then each article would be rinsed after the stack would be removed from the counter top and place in the empty basin. The counter top or table would have to be dried of the soapy water and then the rinsed articles would be placed on the top and again get it wet before the dishes would be hand dried, by wiping with a towel.

Applicant's invention allows each dish to be washed, rinsed and wiped dry without the necessity of going through the steps heretofore enumerated.

DISCUSSION OF THE PRIOR ART

The majority of the devices heretofore provided consisted of a rack for separating the silverware from the dishes and comprised passages from the rack directly to the drain and other passages from the sink to the drain. These devices were for convenience in rinsing and had nothing to do with the concepts of the present invention. Such devices are illustrated, for example, in U.S. Pat. Nos. 3,333,283; 3,377,634; and 2,671,909. There is one patent which does address itself to providing a unit which retains the water in the basin and permits water to run therethrough without draining the basin. Its usage, however, is of limited nature and the present invention far transcends the limits thereof. This U.S. Pat. No. 4,128,905 also has a stopper for the drain.

SUMMARY OF THE INVENTION

This invention pertains to a device for washing dishes and the like by discharging the rinse water directly through the device into the drain while retaining the cleaning water in the basin.

A specific object of the invention is to provide a novel device in which the parts are movable to an out-of-the-way position to provide easy access to the dishes in the sink basin and then after each dish is cleaned the parts are easily positionable beneath the sink faucet to divert the rinse water from the faucet which is cascaded over the cleaned dish so that it may be easily rinsed and the rinse water drained and the dish then being dried and thereafter the parts being moved away to a nonobstructing position and the next dish or other item may be withdrawn from the soapy cleaning water.

The invention comprehends a dish washing aid which comprises a bottom base section and an upper diverter section, each section having a passageway defined by a neck portion, the neck portions being coaxially vertically aligned in telescoped relation so that the sections may be adjusted vertically commensurate with the depth of the wash basin in which the device is mounted with the base section seated upon the bottom wall of the basin about the drain therein.

The invention also comprehends a device in which the top and bottom sections are of funnel-like shape with neck portions eccentrically positioned and coaxially pivotally connected to each other so that upon the device being installed in a basin, the bottom section seals with the bottom wall of the basin and the upper section may be pivoted to a position beneath the sink faucet for diverting rinse water and then positioned out-of-the-way to provide access to the dishes in the soapy water in the basin.

Another object is to provide a novel rinsing device made of flexible material comprising funnel-like portions which are disposed in inverted relation to each other and one portion serving as a base and the other as a diverter, each portion having an annular peripheral rim, the rim of the lower portion being adapted to seat upon the bottom wall of the basin in encompassing relation to the drain, and the flexibility of the material accommodating the rim of the lower portion to flex and conform to the downfall shape of the bottom wall of the basin due to the hydrostatic pressure umposed upon the top side of the funnel-like portion by the water in the basin engulfing the lower portion.

The invention further provides funnel-like identical upper and lower portions or members, each of which has an annular shallow funnel shaped body with a flexible rim and a hollow heck portion, the body being reinforced by a plurality of ribs formed in the body and radiating radially from the neck portion and a plurality of splash guards formed on the body between the ribs.

The invention further comprehends a device in which the top and bottom sections are substantially identical and which have drain neck portions adapted to be coaxially aligned and joined by a sleeve so that the sections may be swiveled about each other and also be adjusted toward and away from each other.

A further embodiment of the invention comprehends a vaccum groove formed in the peripheral rims of the sections which are made of plastic resins such as polyethylene or polypropylene or the like or other compatible elastometic material which may deform to create a continuous peripheral annular vaccum cup for adhering the base portion of the device to the smooth bottom wall of the basin.

These and other objects and advantages inherent in the invention will become more apparent from the specification and the drawings, wherein:

FIG. 1 is a perspective view showing the invention installed in a sink basin and the upper section of the device being disposed in rinsing position and showing a person's hand holding a dish under the water running from a faucet;

FIG. 2 is a side perspective view of the device showing the drain and water level in broken lines;

FIG. 3 is a top plan view of the device showing the swiveling action by arrows;

FIG. 4 is a vertical sectional view taken substantially on line 4—4 of FIG. 3 ;

FIG. 5 is a broken apart vertical sectional view of a portion of a second embodiment of the invention;

FIG. 6 is a top plan view of a third embodiment of the invention, part being shown in phantom lines to indicate that the pattern is repeated entirely circumferentially about;

FIG. 7 is a cross-sectional view taken substantially on the line 7—7 of FIG. 6; and FIG. 8 is a circumferential cross-section taken essentially on line 8—8 of FIG. 6.

DESCRIPTION OF FIGS. 1-4

The invention, described in association with the drawings, is illustrated with a kitchen sink 1 having a top counter-supported rim 2 encompassing a rectangular basin 3. A water faucet 4 is mounted on the rim 2 and extends over the basin 3.

The basin has vertical side walls 5 and an integral bottom wall 6 (FIG. 4) with a drain 7 normally equidistantly spaced from the side walls of the basin. The bottom wall 8 has a slight downfall or slope toward the drain and provides a smooth top surface 10 which is common in stainless steel sinks.

The rinsing device or unit generally designated 12 comprises identical top and bottom funnel-like members or sections 14,16 which for purposes of description may be designated a lower base section 16 and an upper drain section or watter guide portion 14.

Each section comprises an annular body portion 18 and a peripheral flange or rim 20 which extends normal to the axis x—x of an integral neck portion 22 which projects from the convex side 24 of the body portion and is eccentric to the body portion so that it is closer to the rim at one side of the body portion than at its diametrically opposite side. In order to rigidify the large diametric span of the body portion between the neck and the far side of the rim with respect thereto there are provided an aaaray of three channel shaped ribs 27,27 which provide trough-like drainage channels 29,29, the channels facing upwardly in the upper member and those in the bottom member facing downwardly. The inner ends 30 of the ribs flare into the neck portion and the outer ends 32 are spaced radially inwardly from the rim a distance sufficient as to not inhibit the flexibility of the peripheral portion 34 of the body and the rim but sufficient in length to rigidify the body portion from sagging or distorting to an extent as to frustrate the intended function, and that is that the body portion of the bottom section should not collapse due to the hydrostatic pressure of the water 35 (FIG. 2) which inundates it when installed in a sink and the soapy water then is poured thereinto. The static weight of the water in the sink causes the rim of the bottom section to tightly seat upon and flex to conform to the top surface 10 of the bottom wall of the sink basin and seals it to prevent the soapy water from leaking into the drain.

The neck portions of the top and bottom sections are in coaxial (or vertical) alignment and they extend tightly into the opposite ends of a bore 38 of a cylindrical sleeve 40. The upper and lower sections are relatively pivotal about axis x—x and are movable toward and away with respect to each other along said axis to adjust to different sink bowl depths.

It will be apparent that because of the swivel action between the top and bottom sections, it is relatively simple to swing the top section to an out-of-the-way position to one side above the sink basin to provide access thereinto for reaching for a soiled dish which then can be washed in the soapy water in the basin proper and the lifted above the level of the top section which can then be swung to the rinse position shown in FIG. 1, whereupon the tap water is run over the cleaned soapy dish and rinsed and the rinse water can then run through the device and into the drain without running into the suds water. To reach for another dish in the basin, the top section is again swung away and the process heretofore described in washing and rinsing the dishes is repeated. A series of circumferentially extending splash guards 44,44 are provided on each body cone 18 intermediated the ribs 27 between their outer ends to prevent the water from splashing out over the rim and to further reinforce the body section 18.

DESCRIPTION OF FIG. 5

FIG. 5 shows a slightly modified bottom or base section 50 in which parts similar to those of the previous embodiment are identified by the same reference numerals. The section 50 is provided with a U-shaped vaccum groove 52 about its perimeter defined by annular inner and outer flanges 54,56 joined at their upper ends by a bight portion 58. The lower edges of the flanges 60,62 are adapted to seat upon the smooth wet top surface 8 of the bottom wall of the basin in air-tight engagement therewith upon the rim portion 65 incorporating the vaccum groove being pressed against the surface 8 of the basin to obtain vaccum adherence. The hydrostatic pressure will keep the flanges sufficiently tightly engaged with the bottom wall to prevent leakage and thus the two thin, flexible flanges 54,56 serve to dam the water from the drain even if the vaccum grip should be broken.

DESCRIPTION OF FIGS. 6-8

In this embodiment parts identical to those of the previous embodiments will be identified with the same reference numerals.

In this embodiment the body 100 is radially flutted or corrugated, and the flutes 101 comprise an essentially flat bottom wall section 102 and a pair of outwardly diverging webs 103,103 at its lateral edges and adjacent side webs merge into radially oriented apices 104 which serve to rigidify the body with the flutes.

Within each fluting there are provided a series of radially stepped splash guards 105,105 each of which has an outer small angled web or ramp 106 sloping from a peak or apex 107 toward the rim of the body and narrowing into a point 108 in the direction toward the rim. The inner edge of ramp wall 106 merges into the the top edge of a steeply downwardly angled wall 109 which at its lateral edges merges into the side walls 103 of the related flute. This structure defines a series of stepped splash guards so that the rinse water runs from the uppermost guard over those below in a series of rivulets. Also in this embodiment the neck portions 22 telescope over a sleeve 112 which fits tightly within the neck portions 22,22 and has a peripheral outer rib 114 which centers the sleeve through abuttment with the opposing edges of the sleeves.

It will be apparent that preferably the top and bottom members of the device are made identical for inventory and manufacturing purposes, but the invention also comprehends that they could be made differently from each other and that the neck tubes may be made so that they telescope one within the other, thus eliminating the connector sleeve or tube.

Various other forms of the invention will now become apparent to those skilled in the art which are intended to be encompassed within the scope of the appended claims.

I claim:

1. A device for accommodating washing and rinsing of dishes and other articles in a kitchen sink having a single basin comprising side walls and a bottom wall with a drain, the basin being adapted to be filled with wash water and soiled dishes and other articles for soaking and washing therein and there being a faucet extending over the basin for selective discharge of rinse water, said device comprising a pair of superposed members and means including a drain passage and adjustably interconnecting said members, at least one of said members being formed and arranged to seal the drain from the wash water within the basin, and the other of said members comprising a receptacle adapted to extend above the level of the wash water and adapted to drain through said passage and through said one member into the drain and being selectively positionable about said interconnecting means beneath said faucet for diverting water from said faucet over said dishes and articles being withdrawn from said wash water.

2. The invention according to claim 1 and said members being of substantially identical conical shaped structure.

3. The invention according to claim 2 and each of said structures comprising a body portion having a vertex with a drain opening therein communicating with said drain passages.

4. The invention according to claim 3 and said body portion comprising splash guards for inhibiting rinse water from splashing over the periphery of the body portion.

5. The invention according to claim 1 and said interconnecting means being eccentrically disposed with respect to said members.

6. The invention according to claim 1 and each of said members being made of relatively thin flexible plastic material.

7. A dish washing aid device for mounting in a kitchen sink having a basin with a drain and having a faucet above the drain to provide rinse water, said device comprising upper and lower members, said lower member providing a cover over the drain to prevent run off of dish cleansing water adapted to be placed in the basin into said drain, said upper member providing means for diverting rinse water from the faucet, means interconnecting said members and providing a passage therethrough for the rinse water for discharge through said lower member into the drain, said upper member being adjustable about a vertical axis to positions beneath and away from said faucet.

8. The invention according to claim 7 and at least the upper member having an asymetrical conical shaped body with a vertex coaxial with said interconnecting means.

9. The invention according to claim 8 and both of said members being of substantially identical construction.

10. The invention according to claim 9 and each of said members having a series of radial flutes on the bodies thereof emanating from the vertex thereof.

11. The invention according to claim 10 and a plurality of splash guards on the body of each member.

* * * * *